United States Patent [19]

Potucek

[11] Patent Number: 4,800,746

[45] Date of Patent: Jan. 31, 1989

[54] MACHINE AND METHOD FOR MAKING STAR SHAPED FASTENERS

[76] Inventor: Frank Potucek, 6111 28th St. E., Bradenton, Fla. 34203

[21] Appl. No.: 109,988

[22] Filed: Oct. 19, 1987

[51] Int. Cl.[4] ..... B21D 31/00; B21G 3/28; B21G 3/30

[52] U.S. Cl. ..... 72/372; 10/43; 29/33 F; 72/373

[58] Field of Search ..... 10/30, 31, 34, 43, 46, 10/54, 62; 72/197, 198, 372, 374, 375, 373; 29/33 F

[56] References Cited

U.S. PATENT DOCUMENTS

| | | | |
|---|---|---|---|
| 2,014,746 | 9/1935 | Roberegel | 10/54 X |
| 2,800,668 | 7/1957 | Friedman | 10/43 |
| 2,821,727 | 2/1958 | Corckran | 10/54 X |
| 3,695,310 | 10/1972 | Donadio | 10/43 X |
| 4,368,632 | 1/1983 | Thrash et al. | 72/198 |
| 4,637,768 | 1/1987 | Rabe | 10/62 X |

FOREIGN PATENT DOCUMENTS

| | | | |
|---|---|---|---|
| 2034223 | 6/1980 | United Kingdom | 10/54 |

*Primary Examiner*—E. Michael Combs

[57] ABSTRACT

A wire straightener, and multiple preform rollers prepare a continuous length wire for further forming with multiple form rollers having multiple spaced apart notches on an exterior surface edge of the rollers. The notches cause a section of the wire to be non-formed. After the formed wire is fed to a gripper housing where the wire is cut to a predetermined length, the non-formed section is punched to create the fastener head. The end section of the fastener opposite the head is tapered and the finished fastener is ejected from the machine.

14 Claims, 9 Drawing Sheets

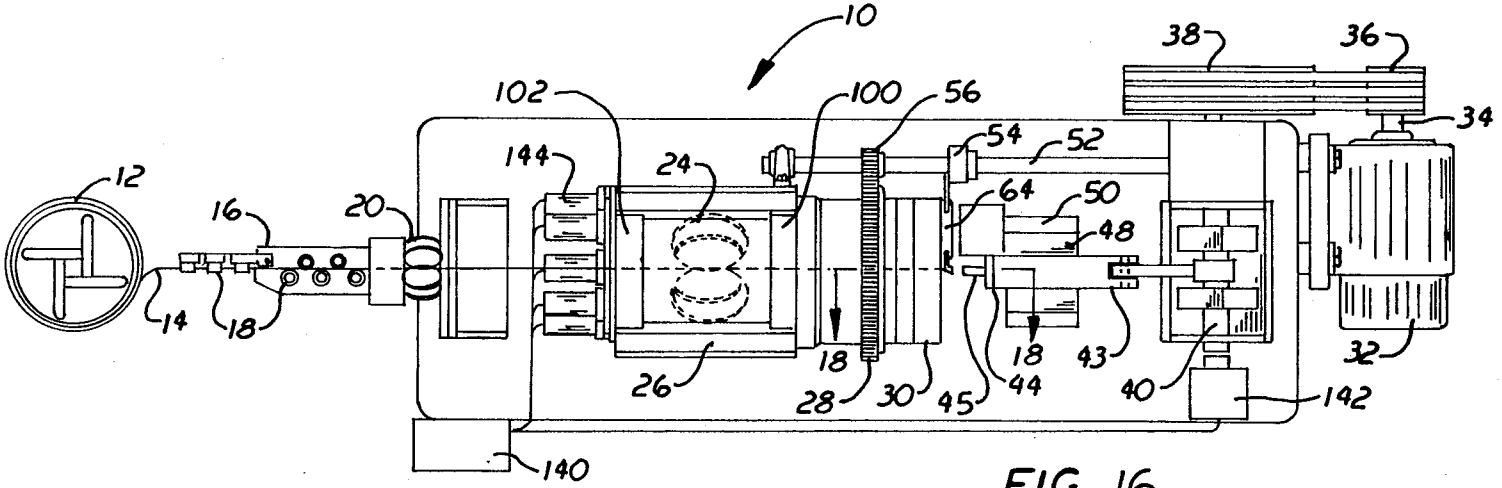
FIG. 16
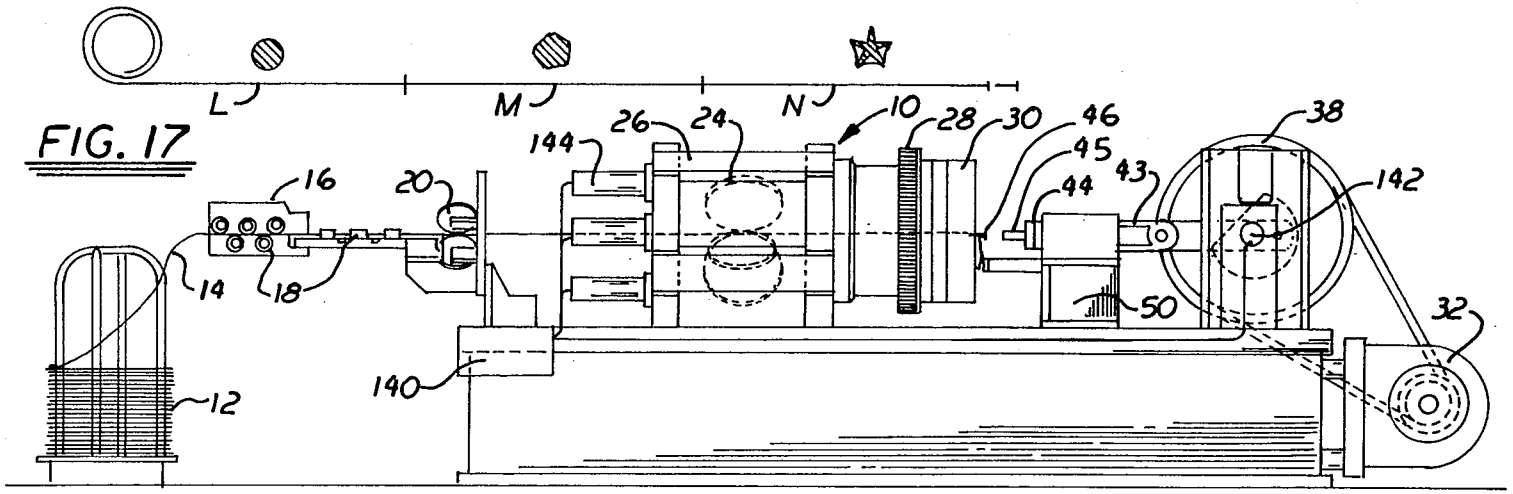
FIG. 17
FIG. 15

MACHINE AND METHOD FOR MAKING STAR SHAPED FASTENERS

BACKGROUND OF THE INVENTION

1. Field of the Invention

This invention relates to nail making machines. More particularly, it refers to a machine and method for making star shaped nails in cross section employing a skip rolling technique to head the nails.

2. Description of the Prior Art

My prior U.S. patent applications Ser. No. 721,757, filed Apr. 10, 1985; U.S. Ser. No. 001,693, filed Jan. 9, 1987, and Ser. No. 012,099, filed Feb. 6, 1987, describe star shaped fasteners. These fasteners employ substantially less metal than conventional fasteners to make a fastener and have greater strength and holding power in wood. Prior art machines such as shown in U.S. Pat. Nos. 1,579,071, 3,372,413 and 4,637,768 employ cooperative wire cutting elements, pointing dies, cooperative wire grippers and heading devices for heading stock wire while the wire is being held in the grippers. In each of these prior art patents a standard segment of the wire stock is formed, cut and then headed. When such a nail is grooved as in U.S. Pat. No. 4,637,768, there is a limited supply of metal for heading and this causes weakness at the head or a decrease in size of the head. Further, work hardening the wire heading section causes metal fatigue and cracking or splitting of the head. A method is needed which will allow enough metal to be available in grooved nail stock to provide for a normal head to be formed.

SUMMARY OF THE INVENTION

I have discovered a machine and method for making star shaped nails employing a skip rolling technique. This technique provides a star shaped nail in cross section, but through a skip rolling step, the same amount of metal is supplied for heading as found in standard nail making operations.

My method involves feeding a continuous length of wire into a wire straightener, feeding the wire among five rollers to form five flats in the wire, feeding the wire among five form rollers having equally spaced apart and aligned multiple notches on an outer edge of each roller and then feeding the wire to a gripper housing. Thereafter, holding the wire between grippers while the wire is headed, fed further, then cut and ejected from the housing.

DESCRIPTION OF THE DRAWINGS

The present invention may be best understood by those having ordinary skill in the art by reference to the following detailed description when considered in conjunction with the accompanying drawings in which.

A is the bulk wire reel,

B is the wire straightening rollers,

C is the group of preforming wire rollers,

D is wire being pulled through the gear box area,

E is the group of notched roll forming wheels,

F is the wire pushed to the gripper housing,

G is the housing containing the wire grippers,

H is the head forming by a cycling ram striking an end of the wire at a non-formed portion, I is the wire feeding to its position for cutting, J is the five cutters forming the point of the nail while cutting the nail from wire, and K is the kicker driving free nail into container.

Figure 2:
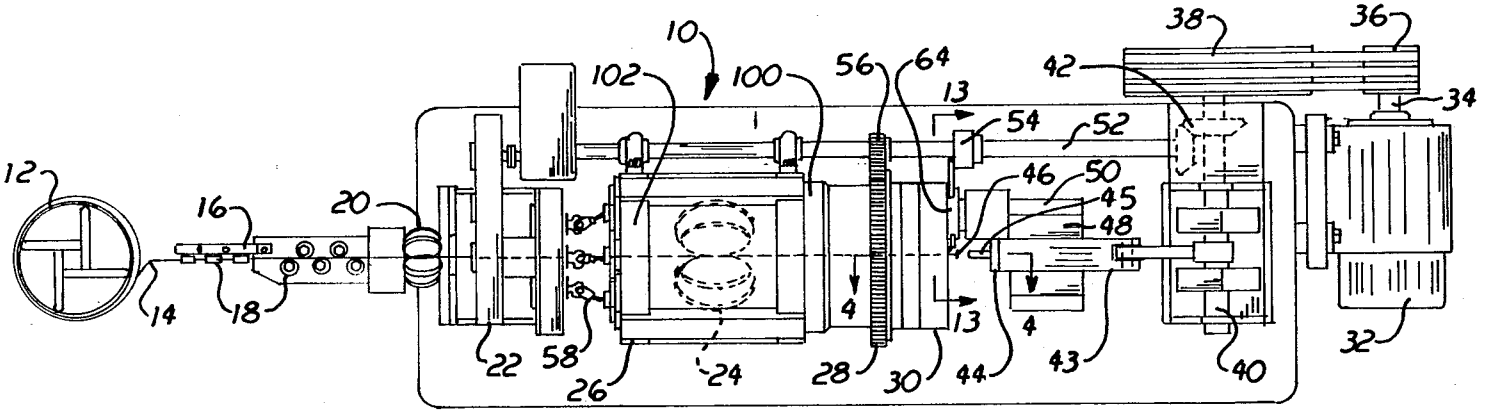
FIG. 2 is a top plan view of the machine for making nails.
Figure 4:
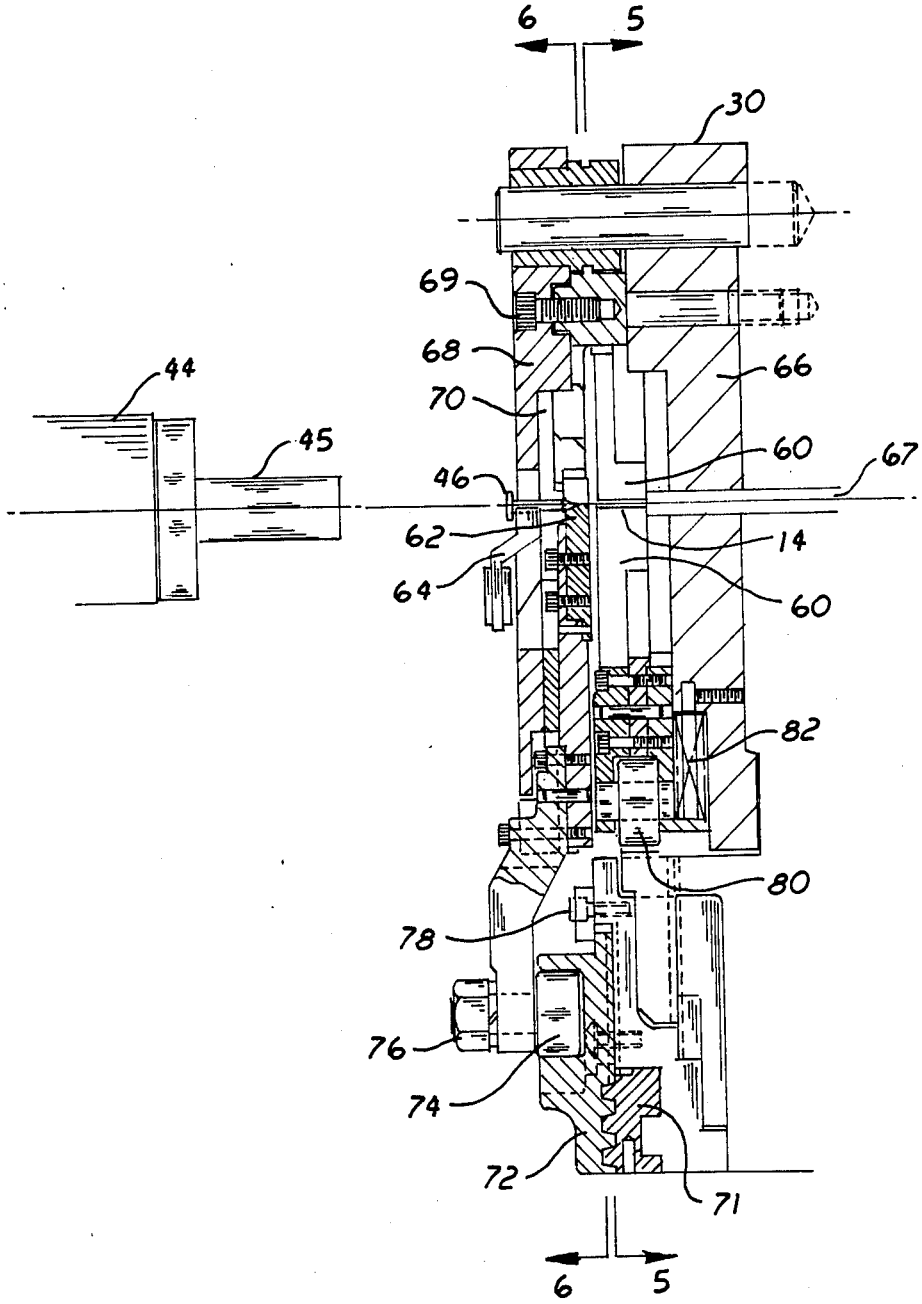

FIG. 4 is a section view along line 4—4 of FIG. 2.

Figure 5:
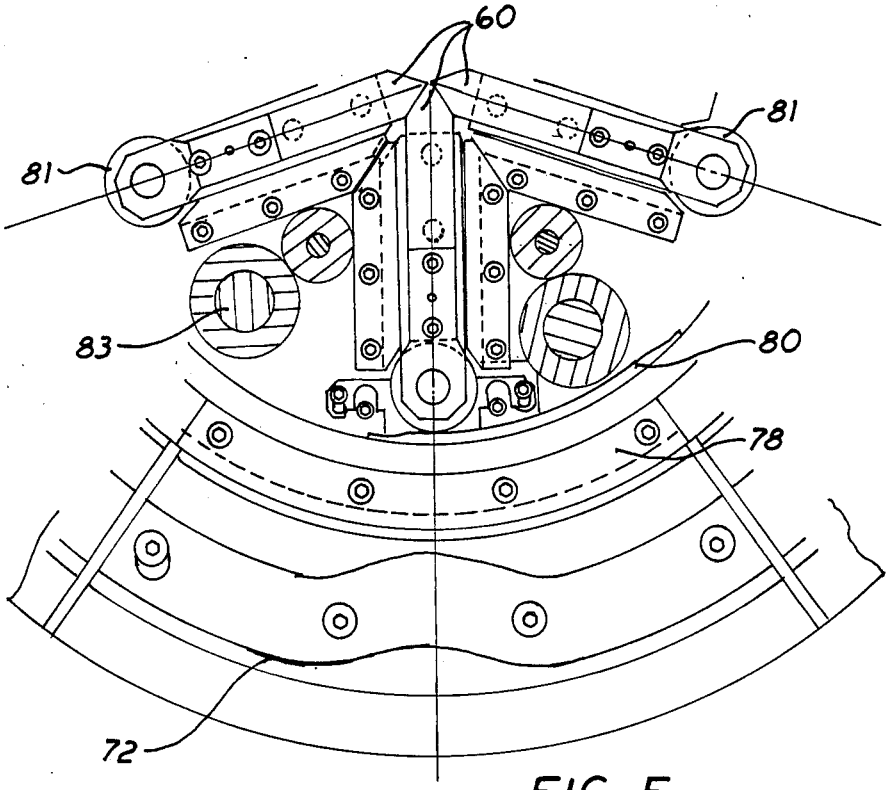

FIG. 5 is a partial section view along line 5—5 of FIG. 4 showing the wire grippers.

Figure 6:
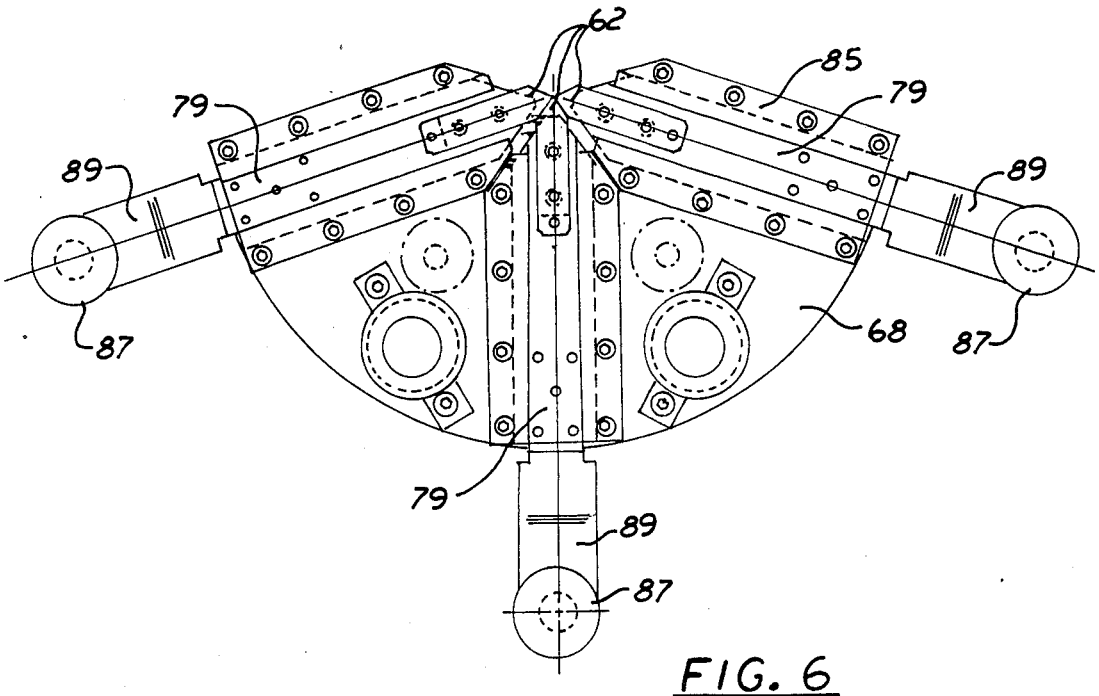

FIG. 6 is a partial section view along line 6—6 of FIG. 4 showing the wire cutters.

Figure 7:
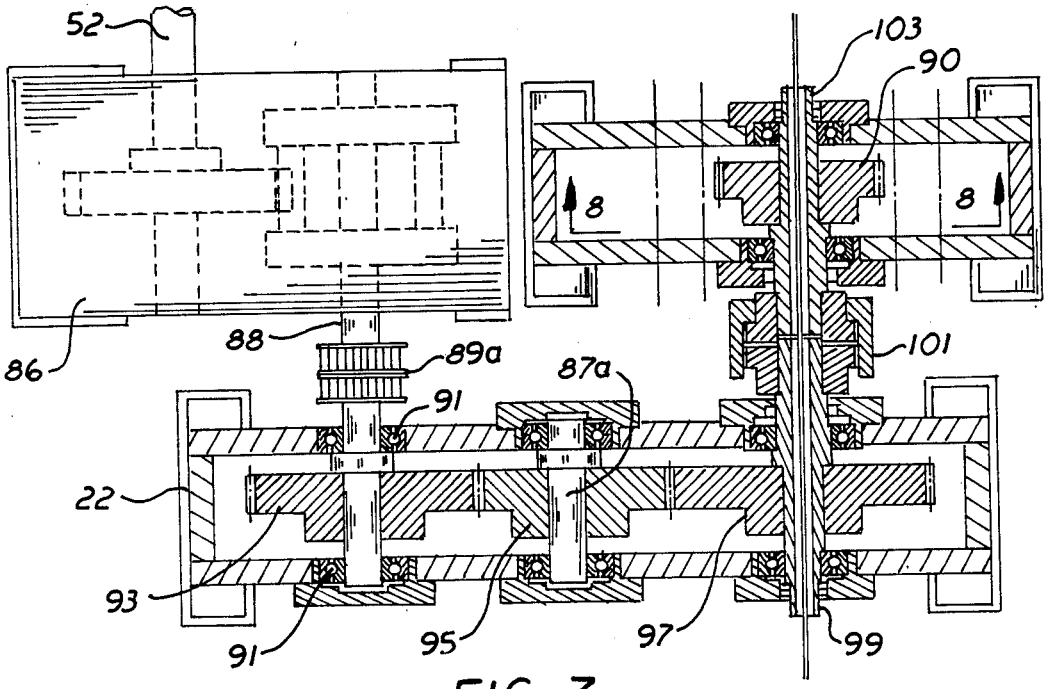

FIG. 7 is a partial section view of the gear boxes.

Figure 8:
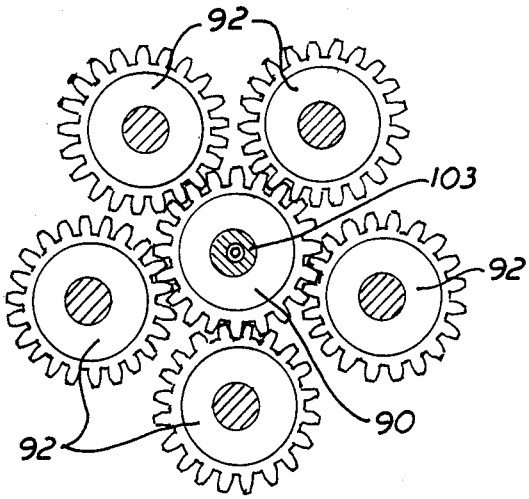

FIG. 8 is a view along line 8—8 of FIG. 7 showing the five drive timing gears.

Figure 9:
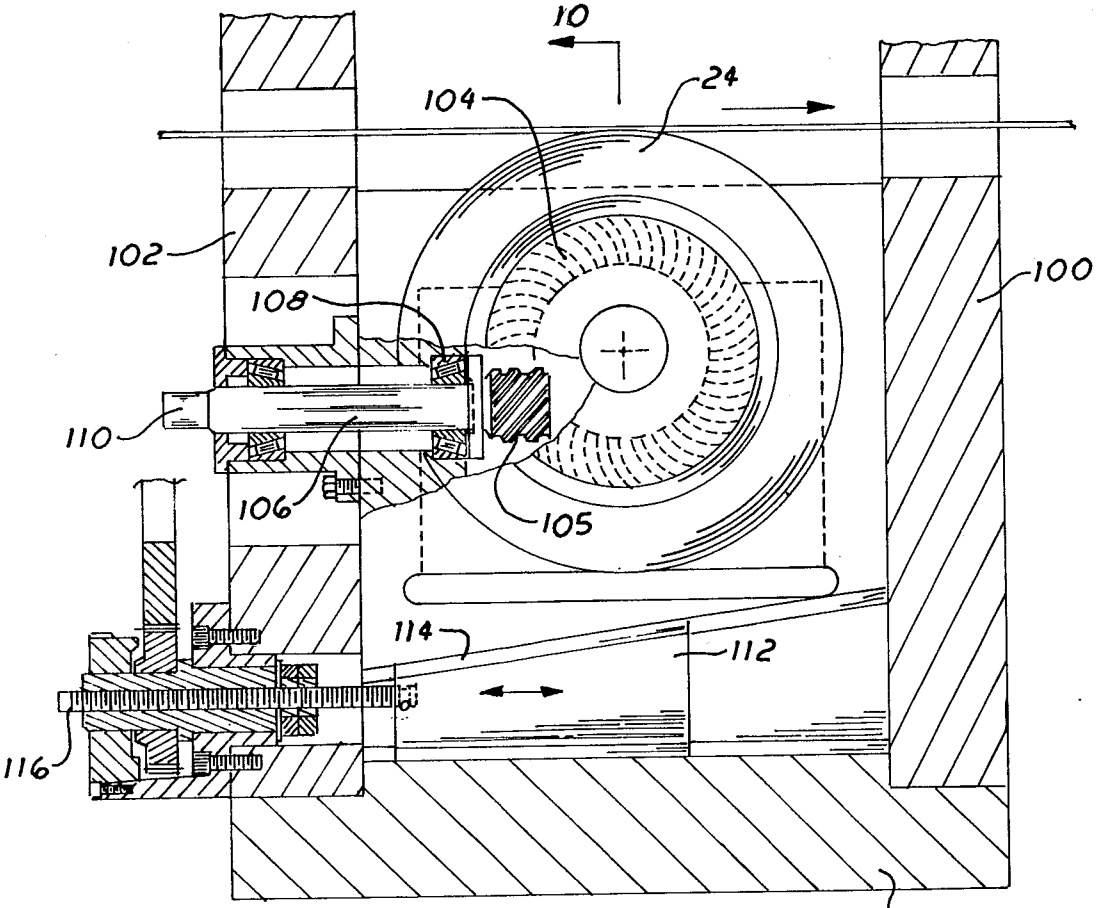

FIG. 9 is a partial section view of the roll form wheel drive and adjustment of FIG. 3E.

Figure 10:
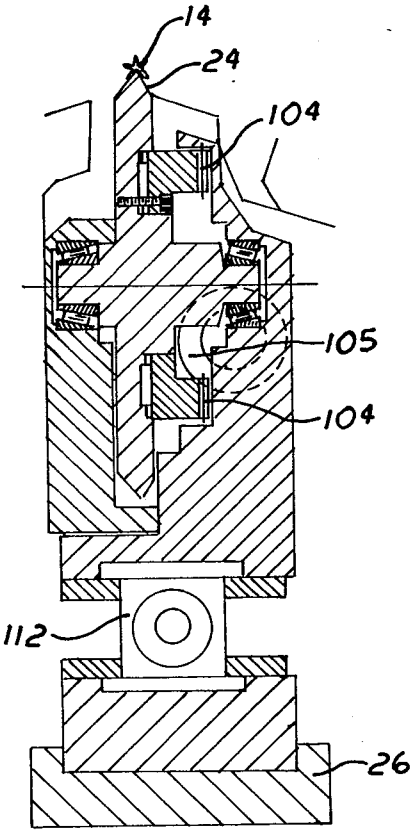

FIG. 10 is a section view along line 10—10 of FIG. 9.

Figure 11:
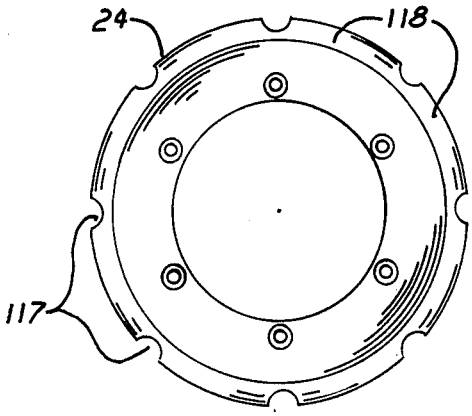

FIG. 11 is a side elevation view of a roll forming wheel with notches on its outer edge.

Figure 12:
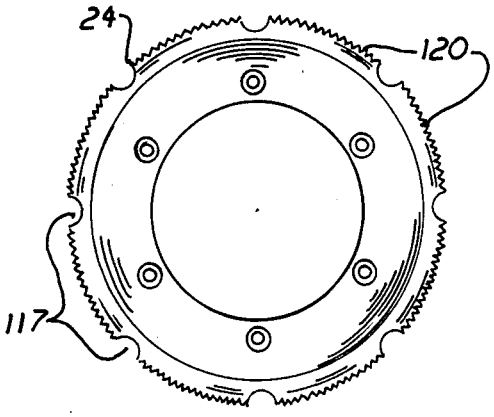

FIG. 12 is a side elevation view of a roll forming wheel with serrations and notches on its outer edge.

Figure 13:
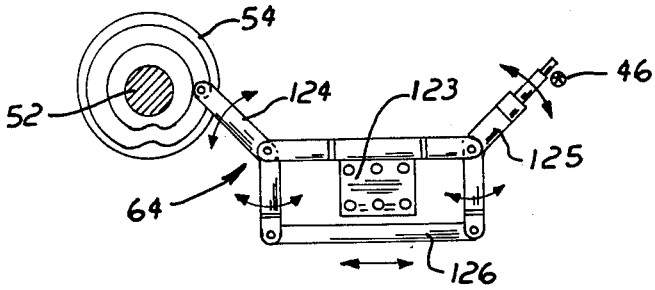

FIG. 13 is a view along line 13—13 of FIG. 2 showing the kicker assembly.

Figure 1:
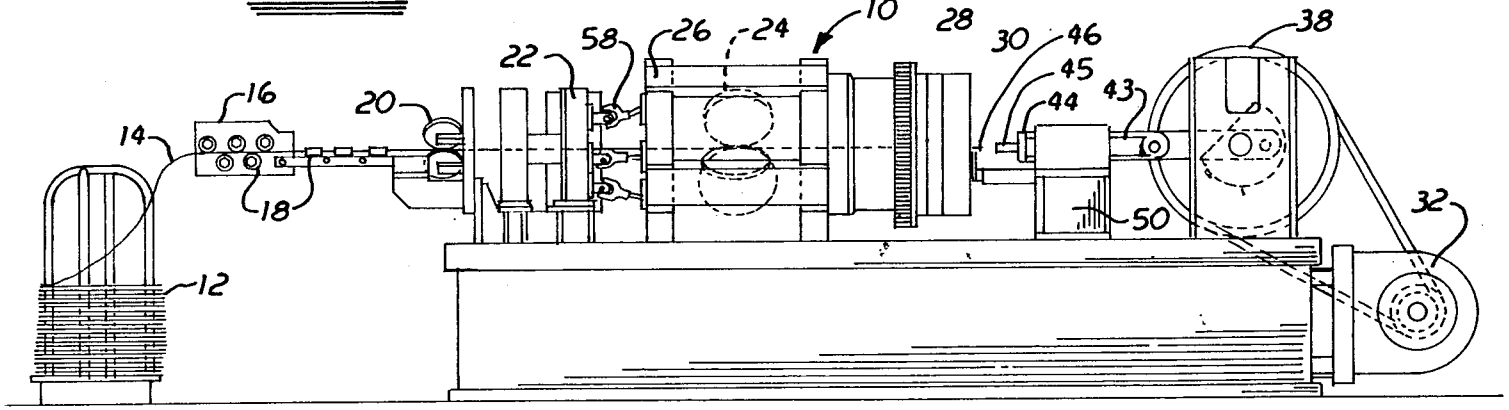
FIG. 1 is a side elevation view of the machine for making nails.
Figure 14:
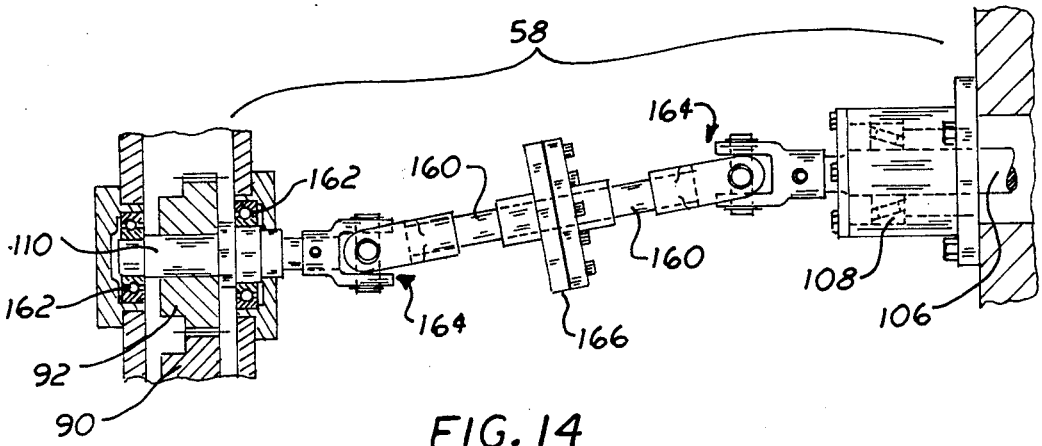

FIG. 14 is a view of a U-joint drive assembly shown in FIGS. 1 and 2.

FIG. 15 is a side elevation view of an alternate machine for making fasteners.

FIG. 16 is a top plan view of the machine of FIG. 15.

FIG. 17 is a flow diagram showing the change in the cross-sectional appearance of the feed wire in various sections of the machine.

Figure 18:
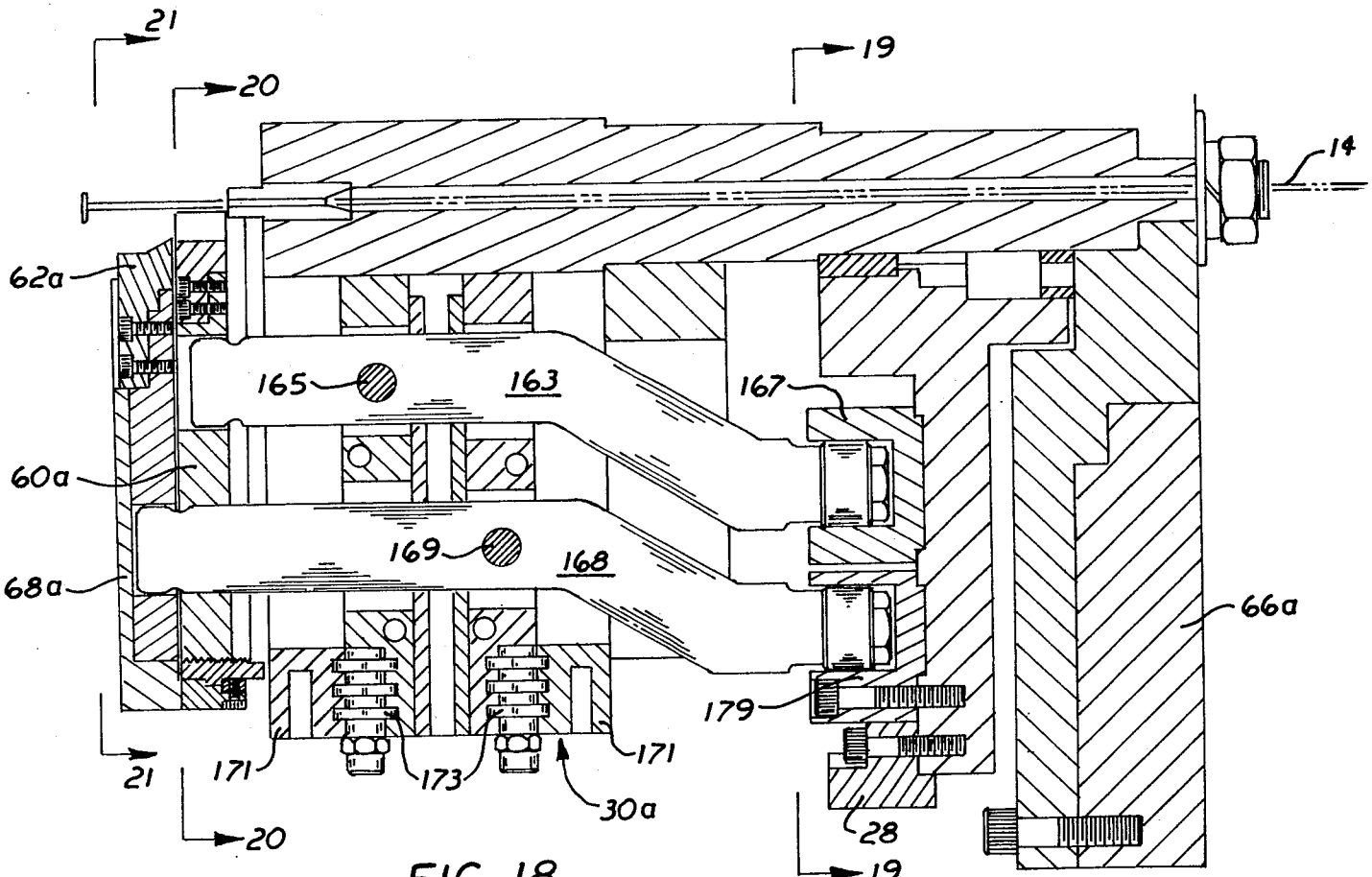

FIG. 18 is a cross-section through lines 18—18 in FIG. 16.

Figure 19:
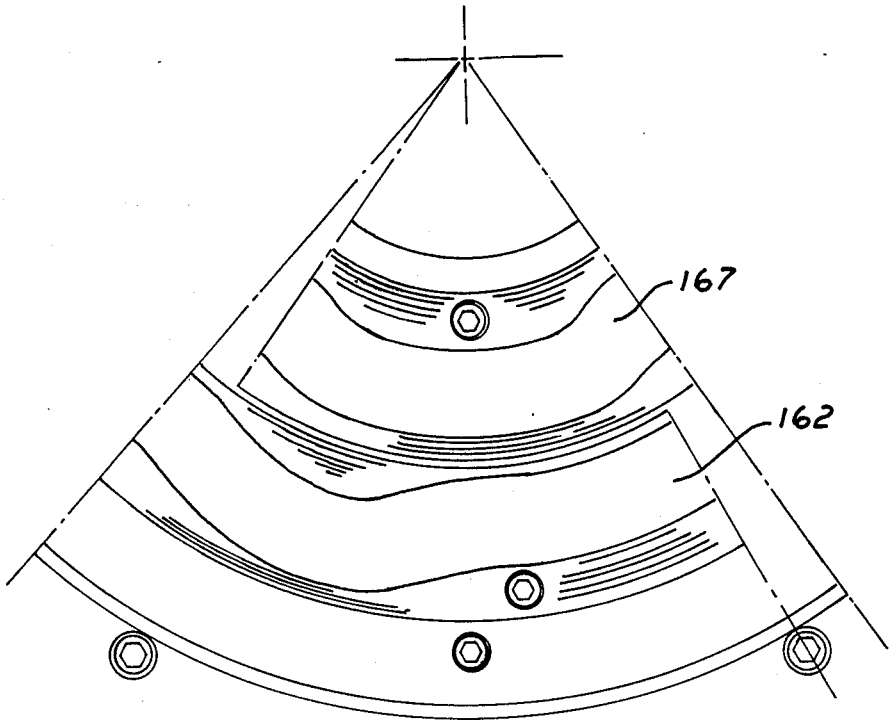

FIG. 19 is a section through lines 19—19 of FIG. 18.

Figure 20:
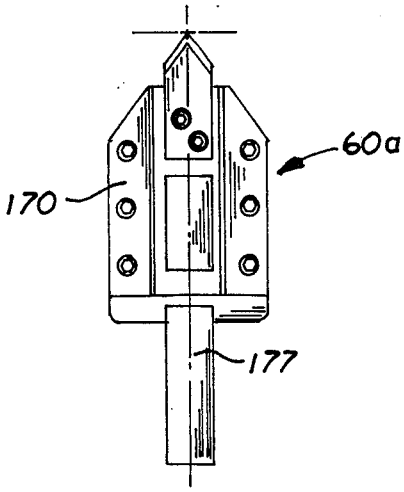

FIG. 20 is a view along lines 20—20 of FIG. 18 showing a gripper head.

Figure 21:
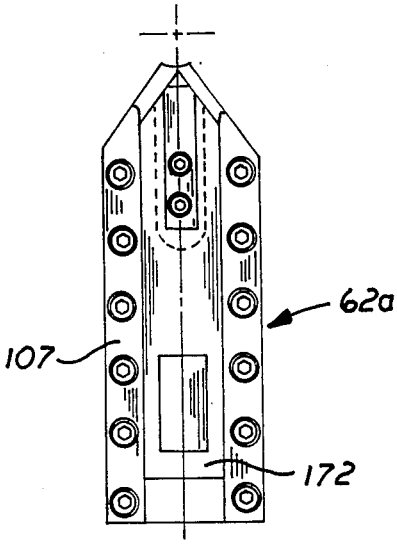

FIG. 21 is a view along lines 21—21 of FIG. 18 showing a cutter head.

DESCRIPTION OF THE PREFERRED EMBODIMENT

Throughout the following detailed description, the same reference numerals refer to the same elements in all figures.

The nail making machine 10 used in a method of my invention contains numerous component parts that cooperate together to make a star-shaped nail in cross section with a head having a size and strength equal to standard nails which are not grooved. My machine 10 is fed by a wire roll 12 from which wire 14, having a gauge of 4 to 22, is fed to a wire straightening device 16. The wire straightener 16 as seen in FIGS. 1 and 2 has a series of rollers 18 in both a vertical and horizontal plane.

From the wire straightening device 16 the wire 14 is drawn through five preform rollers 20 so that the wire is given a five sided configuration, as shown in FIG. 17M. The wire 14 is then pulled through the gear box area 22 to the five forming rollers 24. These rollers 24 are mounted in a housing 26. After passing through rollers 24 the wire 14 has a star-shaped configuration in cross-section, as seen in FIG. 17N.

The wire 14 is the pushed through gear 28 to the gripper housing 30. In the gripper housing 30 the wire is headed, fed further and cut. The heading and cutting operation will be discussed more fully hereafter.

The machine 10 is driven by a motor 32 having a shaft 34 driving the pulley 36, which in turn drives the flywheel 38. The flywheel drives a crankshaft 40 and a bevel gear 42. The crankshaft drives the connecting rod 43 which drives the hammer 44 which in turn drives the punch 45 that places the head on the nail 46. The hammer 44 sits in a bearing saddle 48 which is supported by a housing 50.

The bevel gear 42 drives the shaft 52 in a clockwise direction. Shaft 52 operates cam 54. Shaft 52 also drives the gear 56 which turns gear 28. Gear 56 turns at a 5 to 1 ratio.

The five-spindled gearbox 22 operates five drive assemblies, denoted 58 as a whole. Each drive assembly, as shown in FIG. 14, has a shaft 110 which in turn drives a universal joint 164 which through shaft 160 drives the phasing coupling, each drive assembly 58 driving a separate wheel 24.

Figure 3:
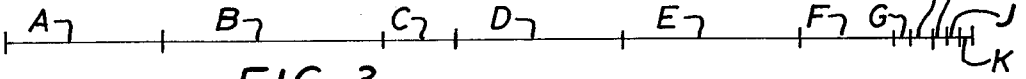
FIG. 3 is a basic operations chart where.

Each method step in the machine operation is shown in FIG. 3, A through K.

Zones F through K on FIG. 3 are shown in FIG. 4. FIG. 4 shows the hammer 44 and punch 45, which has headed nail 46.

Wire 14, having the star-shaped configuration cross section, fed into the gripper housing 30, is held by grippers 60 while the cutter assembly 62 severs and tapers the wire at a prescribed length. A kicker 64 ejects finished nail 46 into a bin, not shown.

The gripper housing 30 contains, in addition to the items disclosed above, a frontplate 66 having a channel 67 therein through which the wire 14 is fed. A cutter plate 68 held in place by bolt 69 is in the back portion of the gripper housing 30. This plate 68 covers the guide channel 70 for the cutter slide assembly 62. A rotating scroll 71 adjusts the cutting cam 72, which in turn controls the cutting roller 74 held in place by bolt 76. A cam retainer 78 keeps the grip cam 80 in place. A spring 82 is used to retract the grippers 60 to release the wire 14.

FIG. 5 shows three of the gripper assemblies 60. However, there are five in total in the machine 10. There are also five gripper cams 80, five cam followers 81 and five cutting cams 72. Alignment rods 83 are present to keep the gripper assemblies 60 in proper alignment.

Sitting over the five grippers 60 are five cutter assemblies 62 shown in FIG. 6. Each cutter assembly 62 is held in place by dovetail gibbs 85 attached to cutter plate 68 retaining dovetail slide 79. Cam wheel 87 moves the cutter stem 89 which in turn moves assembly 62.

FIGS. 7 and 8 show the gear boxes 22 and the cam indexer 86. Shaft 52 drives the cam indexer 86 and then shaft 88 from the indexer drives the change gear box 22 through coupling 89*a*. Bearings 91 support the shaft 88. Shaft 88 drives change gear 93 which turns idler gear 97. Gear 97 drives change gear shaft 99 which drives phasing coupling 101. The phasing coupling 101 drives center gear shaft 103 which drives center gear 90. Idler shaft 87*a* permits a 180° lag in the eventual turning of drive shaft 103 and gear 90. The central gear 90 drives the five gears 92 which are attached to the five form rollers 24 through drive pinions 58.

Each roller 24, as shown in FIGS. 9 and 10, is mounted in housing 26 which has an end plate 100 to the rear of rollers 24 and a front plate 102 in the front portion of rollers 24. A helicon gear 104 drives roller 24 and responds to the helicon pinion 105. Drive shaft 106 through bearing 108 is driven by shaft 110. The shafts 110 are attached to the spindle gears 92.

A wedge block 112 having an inclined plane 114 is adjusted by the lead screw 116 by pulling the wedge block 112 back and forth. The wedge block 112 acts to raise and lower roller 24.

As seen in FIG. 11, the roller 24 has a series of notches 117 and a curved surface 118 between each notch 117. The number of notches 117 and the circumference of the wheel determines the length of the nail. Each notch 117 provides a section of the nail that is not affected by roller 24 and, therefore, provides a skip section of the wire 14 used to head the nail. Such an area provides additional mass of metal for proper heading. Two of the five rollers normally have smooth edges 118, whereas three of the rollers have serrated edges 120, as shown in FIG. 12. These serrated edges provide additional surface area in the grooves of the nail for better contact with the wood.

The kicker mechanism 64 mounted on bracket 123 is shown in detail in FIG. 13. Cam 54 driven by shaft 52 has a cam follower arm 124 attached to the linkage 126 that drives the arm 125 which causes the nail to be pushed out of position so that it will drop by gravity to a retainer bin.

In FIG. 14 the assembly for a typical U-joint drive assembly 58 is set forth in detail. Bearings 162 support shaft 110, which rotates universal joint 164. A phase coupling 166 rotates in response to the universal joint and power is transmitted to the drive shaft 106 and then ultimately to the pinion driven helicon gear 104. The phase coupling 166 controls alignment of notches 117 on wheels 24 so all five wheels have synchronized notches.

FIGS. 15 and 16 show an alternative form of the invention 10, wherein an encoder 142 provides rotary information to the servo amplifier 140 which can be pre-set to various index lengths. These in turn drive the five servo motors 144 driving the five wheels 24.

FIGS. 18 and 19 show an alternate method for gripping and cutting the wire 14 and FIGS. 20 and 21 show the gripper 60*a* and cutter 62*a* slide assemblies employed in the alternate method.

Lever arm 163 pivoting at 165 moves the gripper assembly 60*a* in response to the movement of track cam 167. Lever arm 168 pivoting at 169 moves the cutter assembly 62*a* in response to the movement of cam 179. Adjustable cam wedges 171 containing teeth 173 move within housing 30*a* which has a front plate 66*a* and back plate 68*a*.

The cutter assembly 62*a* has an arm 172 held in place by gibbs 107. The gripper assembly 60*a* has a stem 177 to actuate the gripper. Gibbs 170 hold the gripper assembly 60*a* in place.

Having thus described the invention, what is claimed and desired to be secured by Letters Patent is:

1. A machine for manufacturing fasteners supplied by a continuous roll of wire comprising:

wire straightening rollers receiving wire from the roll, multiple pre-form rollers receiving wire from the straightening rollers to form a number of longitudinally extending flats in the wire corresponding to the number of said preform rollers, multiple synchronized forming rollers for receiving the wire from said pre-form rollers, said forming rollers having equally spaced apart and aligned peripheral forming sections separated by equally spaced apart and aligned multiple notches formed in an outer edge of each forming roller for forming equally spaced apart formations in said wire corresponding to the number and spacing of said peripheral forming sections and equally spaced apart non-formed sections corresponding to the number and spacing of said notches, a gripper housing containing multiple cam operated grippers for receiving and holding the wire after it exits from the forming rollers, a hammer activated heading punch to strike and form a head on a first portion of the wire which is unformed by the forming rollers while held by said grippers, multiple cam-operated wire cutting and tapering elements for cutting and tapering the wire at a second portion of the wire which is unformed by the forming rollers while held by the grippers to form a finished fastener, and a kicker means for removing said finished fastener from the machine.

2. The machine according to claim 1 wherein there are five pre-form rollers and five forming rollers.

3. The machine according to claim 2 wherein three of the forming rollers have a serrated outer edge between each notch and two of the forming rollers have a smooth edge between each notch.

4. The machine according to claim 1 wherein each forming roller is synchronized by a corresponding universal joint drive assembly containing a phase coupling.

5. The machine according to claim 1 wherein the forming rollers are synchronized by multiple corresponding servo motors.

6. The machine according to claim 1 wherein there are five grippers and five cutters in the gripper housing.

7. The machine according to claim 1 wherein the means for removing the finished fastener is a kicker assembly mounted at a downstream end of the gripper housing.

8. A machine according to claim 1 powered by a motor driving a flywheel which drives a shaft connected at multiple positions to take off gears.

9. A machine according to claim 8 wherein the shaft drives a gear having a 5:1 ratio connected to the gripper housing.

10. A method of making wire fasteners comprising the steps of:

feeding a continuous length of wire into a wire straightener, feeding the wire between multiple preform rollers to form a number of longitudinally extending parallel flats in the wire corresponding to the number of said preform rollers;

feeding the wire between multiple synchronized form rollers having equally spaced apart and aligned peripheral forming sections separated by equally spaced and aligned multiple notches formed in an outer edge of each roller and forming equally spaced apart formations in said wire corresponding to the number and spacing of said peripheral forming sections, and equally spaced apart non-formed sections corresponding to the number and spacing of said notches;

feeding the wire from the form rollers to a gripper housing; and in the gripper housing, holding the wire between grippers while heading, cutting and tapering the wire to form a fastener, ejecting the fastener from the housing, the fastener having multiple grooves along a shank corresponding to the number of form rollers and having a tapered first end and a headed second end, the headed end being formed by punching first portions of said non-formed sections on the wire before cutting and tapering second portions of said non-formed sections.

11. The method according to claim 10 wherein there are five preform and form rollers and the fastener produced has five longitudinal grooves along a shank and appears star shaped in transverse cross-section.

12. The method according to claim 11 wherein three of the form rollers have serrated edges and two have smooth edges.

13. The method according to claim 10 wherein a universal joint drive assembly drives each form roller and contains a phase coupling for synchronizing the alignment of the notches formed in the form rollers with notches formed in adjacent form rollers.

14. The method according to claim 10 wherein servo motors drive the form rollers in synchronization.

* * * * *